United States Patent [19]

Crippen et al.

[11] 4,121,994

[45] Oct. 24, 1978

[54] ANODE SUPPORT MEANS FOR AN ELECTROLYTIC CELL

[75] Inventors: Monte Dennis Crippen, Kennewick, Wash.; Cyril James Harke, Burnaby; Bernardus Johannes Mentz, Maple Ridge, both of Canada

[73] Assignee: Hooker Chemicals & Plastics Corp., Niagara Falls, N.Y.

[21] Appl. No.: 852,429

[22] Filed: Nov. 17, 1977

[51] Int. Cl.[2] ..... C25B 11/00

[52] U.S. Cl. ..... 204/286; 204/297 R

[58] Field of Search ..... 204/286, 279, 252, 266, 204/297 R

[56] References Cited

U.S. PATENT DOCUMENTS

| | | | |
|---|---|---|---|
| 3,719,578 | 3/1973 | Berthoux et al. | 204/252 |
| 3,836,438 | 9/1974 | Sartre et al. | 204/252 X |
| 3,891,531 | 6/1975 | Bouy et al. | 204/252 X |
| 3,928,167 | 12/1975 | Bouy et al. | 204/286 |

*Primary Examiner*—John H. Mack
*Assistant Examiner*—D. R. Valentine
*Attorney, Agent, or Firm*—Peter F. Casella; Thomas T. Gordon

[57] ABSTRACT

A technique for affixing anode support rods to the wall of a chlor-alkali type of electrolytic cell, wherein the support rod is positioned and affixed to the cell wall through a welding operation providing a leak proof seal and electrical contact, as well as providing for its easy removal and replacement for maintenance purposes.

4 Claims, 1 Drawing Figure

ANODE SUPPORT MEANS FOR AN ELECTROLYTIC CELL

BACKGROUND OF THE INVENTION

The present invention relates to an electrolytic cell and the method by which the anode support means are affixed to the interior surface of the cell. More specifically, the invention relates to a technique for affixing, in a precise manner, anode support rods to a wall or base surface of the interior cell lining by a technique that allows precise placement, eliminates leakage problems and permits the easy replacement of the anode support rod for maintenance purposes.

Electrolysis of alkali metal halide brines have been performed in mercury, diaphragm and membrane cells. These cells consist of anodes, cathodes, and may have separate anode and cathode chambers depending upon the configuration of the cell employed. Diaphragm cells, used in the electrolysis of metal halide brines, generally employ a foraminous metallic cathode and a fluid permeable diaphragm overlaying the cathode which permits the hydraulic flow of electrolyte from the anode chamber through the diaphragm into the cathode chamber. The diaphragm cells most widely used today are of the circulating electrolyte type in which the cathodes, anodes and associated diaphragms are arranged vertically and allow for easy electrolyte flow.

In the early development of electrolytic cells, the anode was constructed of a sheet of graphite and was embedded into the base of the cell through the use of molten lead, and insulated with asphalt. The disadvantages of graphite anodes are well known to those skilled in the art and will not be discussed herein.

The advent of metallic anodes with an electro-conductive coating has led to the design and operation of new configurations of cell construction. Currently, many electrolytic cells position the anodes in a vertical position and construct the anodes of a planar design and position them within the confines of the cell by attaching them to support posts or rods rising from the base of the cell. The anodes are usually of a foraminous nature and require precise positioning relative to the cathode structure within the cell. These foraminous sheets are usually bolted or clamped to the vertical anodes support rod. The positioning of these anode support rods to the base of the cell must be precise and firmly attached so that the later positioning of the anode sheets can be easily accomplished. This type of construction is illustrated in U.S. Pat. No. 3,859,196 as well as in U.S. Pat. No. 3,591,453 which illustrate the current state of the art.

Alternatively the electrolytic cell may be designed in a manner, whereby the anode support rods may be attached to a side wall of the cell, rather than to the cell base. Therefore, the term "cell wall" used in this disclosure shall encompass any of the surfaces that form the retaining outline of an electrolytic cell.

Electrical contact must be made between the applied power source and the anode in the cell. This has been accomplished in the prior art by extending the rod through the cell wall and attaching the electrical feed at the end of the anode support rod that is exposed. This electrical feed system generally employs heavy busbars due to the high current flow through the cell. The anode support rods and busbars must be constructed of a highly conductive material in order that the resistance to current flow be reduced to as small a level as possible.

In modern diaphragm type cells, the base is composed of a steel plate to provide the physical strength for the cell, and also to protect the busbar structure from corrosive attack of the electrolyte. The steel is normally protected from electrolyte attack by placing between the steel and the electrolyte, a protective layer. This protective layer has been of a flexible non-corrosive rubber type material, or in more recent applications, of a metallic sheet composed of a metal or alloys which are resistant to attack of the electrolyte used in the cell. A common type of metallic protective barrier for chloralkali cells has been the use of a titanium sheet which withstands the corrosive attack. The previous types of protective layers such as flexible rubber type sheets, fastened to the base or wall of the cell, created problems in leakage of the electrolyte to the surfaces requiring protection through the openings in the rubber sheet wherein the anode post or riser extended through the base of the cell. The replacement of these rubber-like sheets with a thin layer of a non-reactive metal, such as titanium, has allowed the cell designers to prepare better leak proof cells. In addition, the incorporation of the metallic sheet allows the welding of components to the inner surface of the cell.

The positioning of the anode support rods in an electrolytic cell must be done with precision, and the technique of attaching these rods to the wall or base of the cell has been accomplished by several techniques. A common approach has been to provide an opening through the base of the cell and to bolt the anode support rod to the base of the cell, and in so doing, provide contact with the busbar structure located near the base of the cell. This method of fastening the anode support rod to the base has produced problems which include leakage of electrolyte from the cell around the opening, and retaining the rod in its initial position after operation of the cell due to the corrosion. Other techniques for fastening anodes or anode support rods to the base of the cell have been through other simple bolting operations, and through the use of bolted guides and clips. These are described in U.S. Pat. Nos. 3,591,483; 3,719,578; and 3,796,648, which illustrate the current state of the art.

SUMMARY OF THE INVENTION

In accordance with the present invention, there is provided a method for the positioning of anode supports to the cell wall of an electrolytic cell wherein the interior lining of the cell is metalic, such as titanium metal, through unique steps of welding the support rod to the cell base or busbar in a manner that eliminates the warpage common to the welding of large metallic structures, and provides a leak-proof seal.

The typical anode support member used in commercial chloralkali cells is rod shaped and is composed of a titanium rod or a titanium coated rod, as titanium is an excellent material to combat the corrosive effects of the brine used in chloralkali electrolytic cells. The fastening of such support rods to the base of a cell through the process of simple welding results in the placing of much stress and strain upon the rod and the metallic wall mateial used in the cell construction, and resulting from the stress and strain of welding, warpage and misalignment of the anode rods occurs. Incorporated into the design of some anode rods, has been a shoulder to increase the seating area of the rod on the cell wall. This has assisted in the joining of the rod to the cell wall but has not eliminated the problem. The present invention incorporates the use of the shoulder on the base of the rod to serve as a welding point for attaching a washer-shaped metallic base plate, which increases the surface of the contact area between the rod and the base of the cell. This metallic plate is of any configuration having therein a centrally located opening through which opening the anode support member can be inserted, with said opening of a size smaller than the shoulder or base of the rod, so that the support rod will rest upon the plate. The term washer shaped metallic plate or metallic plate will hereinafter be called washer in the specification for convenience, but shall denote any configuration of the external edge of the plate.

The washer shall be of a size which is greater than the diameter of the rod or shoulder, if present, and of a thickness less than the diameter of the rod. The washer will therefore extend beyond the edge of the anode support rod and provide a metallic surface that will absorb the stresses and strains, induced by the heat of welding, rather than transferring the stresses to the anode post. These stresses and strains could distort the washer, but will not distort the configuration of the rod.

After the welding of the washer to the anode rod or shoulder, and prior to insertion into the cell, any warpage or distortion that occurred by this welding operation can be removed by machining, pressing or other restraightening operation to restore a flat surface to the attached washer. Then, by placing the anode support rod with the welded washer attached to its shoulder into the cell, the metallic washer will seat against the metallic surface of the cell wall, and this washer can now be easily welded to the cell wall. With the extension of the surface of the plate, the stresses and strains of this welding step will be transmitted to the plate portion only, and not to the rod, thus allowing the rod to be accurately positioned into the cell. This weld will provide a leak-proof seal for the electrolyte at the cell base connection point.

The present invention provides a technique for positioning anode support rods and eliminating the problems of electrolyte leakage.

BRIEF DESCRIPTION OF DRAWING

The FIGURE is a modified cross-sectional view of a typical anode support rod installed in an electrolytic cell applying the improved construction and advantages of the present invention.

DESCRIPTION OF THE EMBODIMENTS

Figure 1:
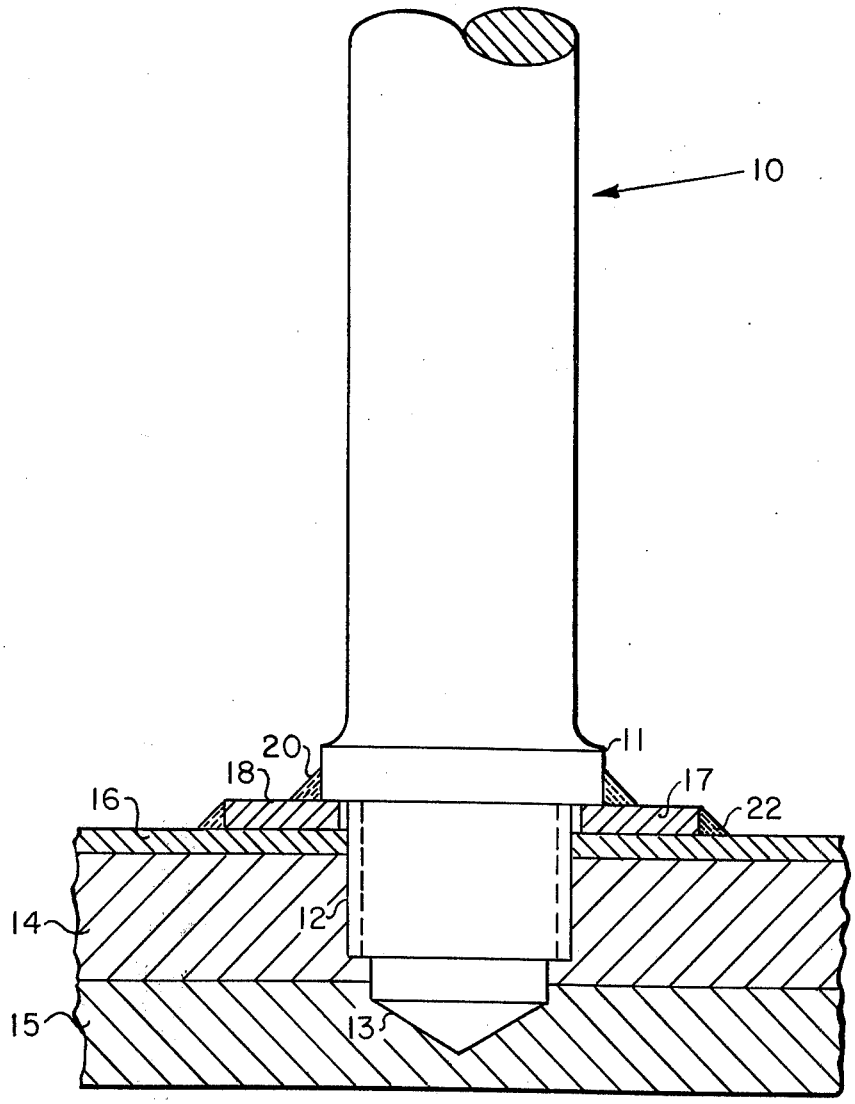

It should be understood that the novelty of the instant invention does not reside in the design or construction of the anode configuration, or the anode support post. Any of the constructions currently in use are acceptable, and may be adapted to the present invention. The preferred embodiment of this invention can best be appreciated by referring to the drawings. Accordingly, referring now to the FIGURE, there is illustrated thereon a modified cross-sectional view of an anode support rod mounted to an electrolytic cell wall. The anode support rod 10 has a shoulder 11, which is an integral part of the rod, and a threaded portion 12 which will mate with the steel section of the wall 14. Electrical contact between the anode rod 10, and the busbar 15 will be made through the shape end of the rod 13 which will be forced onto the busbar by the application of the rod into its position in the cell.

Prior to the insertion of the anode support rod into its position in the cell, a washer 17, is welded to the shoulder of the support rod by the use of weld 20. This washer shall be of a diameter greater than the anode support rod, and of a thickness less than the diameter of the said rod, since the stresses and strains of welding will cause distortions to occur in the washer rather than in the rod. The amount of heat generated during this welding step is transmitted to the anode support rod 10 as well as to the washer 17, but as the washer is of a smaller physical volume, the washer will be distorted much faster than the massive support rod 10. After cooling of the welded unit, any distortion or warpage induced into the washer by the necessary heat of the welding step can be removed by pressing, machining, or other means to restore the washer to its original contour, so that the surface of the washer will seat upon the cell wall interlining metallic layer.

The anode support rod with washer attached can now be placed into the electrolytic cell and placed in its proper position. If the support rod contains a threaded portion 12, it can be tightened into the steel plate 14 with the desired torque to position it into its proper place, the washer being in contact with the metallic interliner. The assembly is now welded into place by placing a weld 22 between the washer previously attached to the anode support rod, and the metallic lining of the electrolytic cell. Since this weld is between relatively thin sections of metal, little heat will be generated that will pass either the steel support plate of the cell, or the anode busbar of the cell so there will be no expansion of the threaded portion of the rod which would cause loss of mechanical strength, or distort the positioning of the rod. Weld 22 will also provide a very effective means of sealing the support rod to the cell and eliminate anolyte leakage.

The anode support rod may be fabricated from various conductive materials such as copper, steel, or equivalent materials, but the use of this type of material is subjected to attack by the anolyte on a rapid basis. Therefore, it is desirable to overcoat the conductive material with a metallic layer that is not subjected to degradation by the anolyte. A typical overcoating used in commercial electrolytic cells is titanium, and the entire anode rod could be constructed of titanium metal; but, due to the economics, it is common to use a core material for the rod of a highly conductive metal such as copper and then apply a titanium overcoat or sleeve to the rod. The assembly procedure as described above used titanium as the protective coating or layer on the anode support rod, and as the lining material for the inner surface of the cell, but this should not be deemed to limit the scope of this invention, as other metallic materials can be substituted for the titanium as a protective layer for the electrolytic cell. Various combinations of titanium with other metals forming alloys have been utilized extensively in commercial operations, and any metallic substrate used as an inner liner or protective coating shall be deemed within the scope of this invention.

The exact configuration of the anode support rod will vary from cell to cell. The design shown in the FIGURE is to be considered as typical of an anode support rod. The threaded extension of the rod as shown in the FIGURE is a convenient means of attaching the rod to the base structure of the cell in order to maintain positioning of the rod within the cell, as well as electrical contact. An added feature of the threaded portion is to provide a means for the application of pressure between the base with attached washer of the anode support rod and the interior surface of the cell to assist in the elimination of leakage in an electrolytic cell. The shoulder portion 11 of the rod may or may not be present on designs of the anode support rod, since its principle purpose previously was to provide a larger seating area for the rod against the wall of the cell. Through the use of a washer meeting the requirements enumerated above, on the base of the rod prior to its assembly into the cell, other rod designs could be utilized and are deemed to be included within the scope of this invention.

The shaped end 13 of the anode support rod as illustrated in the FIGURE is the primary contact point between the anode busbar 15 and the anode support rod. This should not be deemed as the sole contact point for the anode to the busbar lead-in, as the conductive bar is attached to the steel support plate of the cell by welding (not shown in the FIGURE) which will amplify the contact area, and insure contact between the anode support rod and the steel base plate 14. The design or configuration of the shaped end is not limited to the design shown in the FIGURE, and it is deemed within the scope of this invention that the configuration may be altered to other shapes or designs.

The lead-in busbar should be constructed of a highly conductive material, such as copper to eliminate resistance to current flow, but is not deemed to be so limited, as many other highly conductive metals may be substituted therefor. The use of a copper busbar to feed the current to the anode support rod is a convenient system and is well documented by the commercial electrolytic cells now in use. The use of copper busbars is not essential to the operation of an electrolytic cell as the current could be directed from the lead-in point of the cell through the steel base of the cell, and the copper could be eliminated. If this were to be done, the thickness of the steel would need to be adjusted in order to allow for the flow of current through the steel. Fabrication costs of the cell base could be substantially reduced when inexpensive steel is substituted for costly copper. The increased thickness of steel will also serve to dissipate the heat generated during the electrolytic process, as well as assisting in the regulation of the temperature of the cell.

During the operation of electrolytic cells using an anode post of the type described, malfunctions of the anode structures occur and maintenance must be accomplished to replace the defective anode. It has been found that from time to time the anode post must be removed and replaced. The disclosed invention allows for easy removal of the anode support rod by a technique involving the insertion over the anode support rod of a rotary saw whose blade will engage the washer surface 18. Through the rotation of the saw, the washer 17 wil be severed between the welds 20 and 22, and the anode support rod may be easily removed from the base and replaced. In the event the removal of the anode support rod is desired, the sawing of the washer 17 will leave on the base of the cell, the remaining portion of the washer, and its corresponding weld 22 in a doughnut shape. This doughnut can be easily removed without distorting the base of the cell, and will allow the insertion of a new anode support rod with an attached washer in the manner previously described.

Since numerous changes may be made in the above-described apparatus, different embodiments of the invention may be made without departing from the spirit and scope thereof. Therefore, it is intended that all matter contained in the foregoing description are shown in the accompanying drawing, shall be interpreted as illustration and not in a limiting sense.

What is claimed is:

1. In a method of rigidly mounting an electrically conductive anode support member to a metallic wall of an electrolytic cell to prevent leakage of anolyte from the cell, said anode support member having connected means at one end for engaging with an opening in the cell wall, the improvement comprising the steps of (a) surrounding the support member with a metallic plate at a position proximal to the connecting means of said support member, (b) rigidly coupling by welding the plate to the support member, (c) mounting the support member in the cell wall opening whereby the plate fits flush against the cell wall making electrical contact with said wall, and (d) welding the plate to the cell wall.

2. The method of claim 1 wherein the surface of the metallic plate is distorted by the welding step and substantially restored to its original shape prior to mounting in the cell wall.

3. The method of claim 1 wherein the support member, the plate and the cell wall are composed of titanium or titanium alloys.

4. The method of claim 1 wherein the surface coating of the support member, the plate and the cell wall are titanium or titanium alloys.

* * * * *